US010259092B2

(12) United States Patent
Mizogaki

(10) Patent No.: US 10,259,092 B2
(45) Date of Patent: Apr. 16, 2019

(54) CYLINDRICAL WORKPIECE AND A METHOD AND AN APPARATUS FOR MACHINING THE CYLINDRICAL WORKPIECE

(71) Applicant: NTN Corporation, Osaka-shi (JP)

(72) Inventor: Wataru Mizogaki, Iwata (JP)

(73) Assignee: NTN Corporation, Osaka-shi (JP)

( * ) Notice: Subject to any disclaimer, the term of this patent is extended or adjusted under 35 U.S.C. 154(b) by 85 days.

(21) Appl. No.: 15/368,577

(22) Filed: Dec. 3, 2016

(65) Prior Publication Data

US 2017/0144263 A1 May 25, 2017

Related U.S. Application Data

(63) Continuation of application No. PCT/JP2015/066095, filed on Jun. 3, 2015.

(30) Foreign Application Priority Data

Jun. 4, 2014 (JP) ..... 2014-116271

(51) Int. Cl.
*B24B 5/04* (2006.01)
*B24B 41/06* (2012.01)
*B24B 47/12* (2006.01)

(52) U.S. Cl.
CPC ..... *B24B 5/04* (2013.01); *B24B 41/06* (2013.01); *B24B 41/062* (2013.01); *B24B 47/12* (2013.01)

(58) Field of Classification Search
CPC ..... B24B 5/04; B24B 41/06; B24B 41/062; B24B 41/12
(Continued)

(56) References Cited

U.S. PATENT DOCUMENTS 3,812,623 A * 5/1974 Kikuchi ..... B24B 5/06 451/21
4,827,673 A * 5/1989 Waelti ..... B24B 5/01 451/243

(Continued)

FOREIGN PATENT DOCUMENTS

DE 38 40 596 6/1990
JP 54-142894 10/1979

(Continued)

*Primary Examiner* — George B Nguyen
(74) *Attorney, Agent, or Firm* — Harness, Dickey & Pierce, P.L.C.

(57) ABSTRACT

An apparatus for machining a cylindrical workpiece has a hollow spindle with a driving center on its tip end. The hollow spindle is rotationally journaled within a spindle unit. A tail stock spindle, with a centering center on its tip end, is rotationally supported and axially movable within a centering unit. A shaft-like kelly is non-rotationally and axially movably supported within an inner bore of the spindle. A drive rotates the spindle. Cylinders axially drive the kelly and the tail stock spindle, respectively. The spindle, the tail stock spindle and the cylinders are arranged on the same axial line. The cylindrical workpiece is sandwiched between the driving center and the centering center. An outer circumferential surface of the workpiece is finish machined while rotating the workpiece under a condition where the kelly engages the workpiece within an inner bore of the workpiece.

6 Claims, 7 Drawing Sheets

(58) Field of Classification Search
USPC ..... 451/51
See application file for complete search history.

(56) References Cited

U.S. PATENT DOCUMENTS

| | | | | | |
|---|---|---|---|---|---|
| 5,643,065 | A * | 7/1997 | Whitesel | B23Q 16/028 | 451/403 |
| 5,700,186 | A * | 12/1997 | Hykes | B24B 5/42 | 451/251 |
| 2013/0025124 | A1* | 1/2013 | Nagel | B23B 41/12 | 29/888.01 |
| 2017/0252886 | A1* | 9/2017 | Junker | B24B 27/0061 | |

FOREIGN PATENT DOCUMENTS

| | | |
|---|---|---|
| JP | 56-176101 | 12/1981 |
| JP | 57-211401 | 12/1982 |
| JP | 2-237764 | 9/1990 |
| JP | 6-312302 | 11/1994 |
| JP | 07-227760 | 8/1995 |
| JP | 2002-361504 | 12/2002 |
| JP | 2003-245855 | 9/2003 |
| JP | 2005-059182 | 3/2005 |
| JP | 2012-066355 | 4/2012 |
| WO | WO99/01253 | 1/1999 |

* cited by examiner

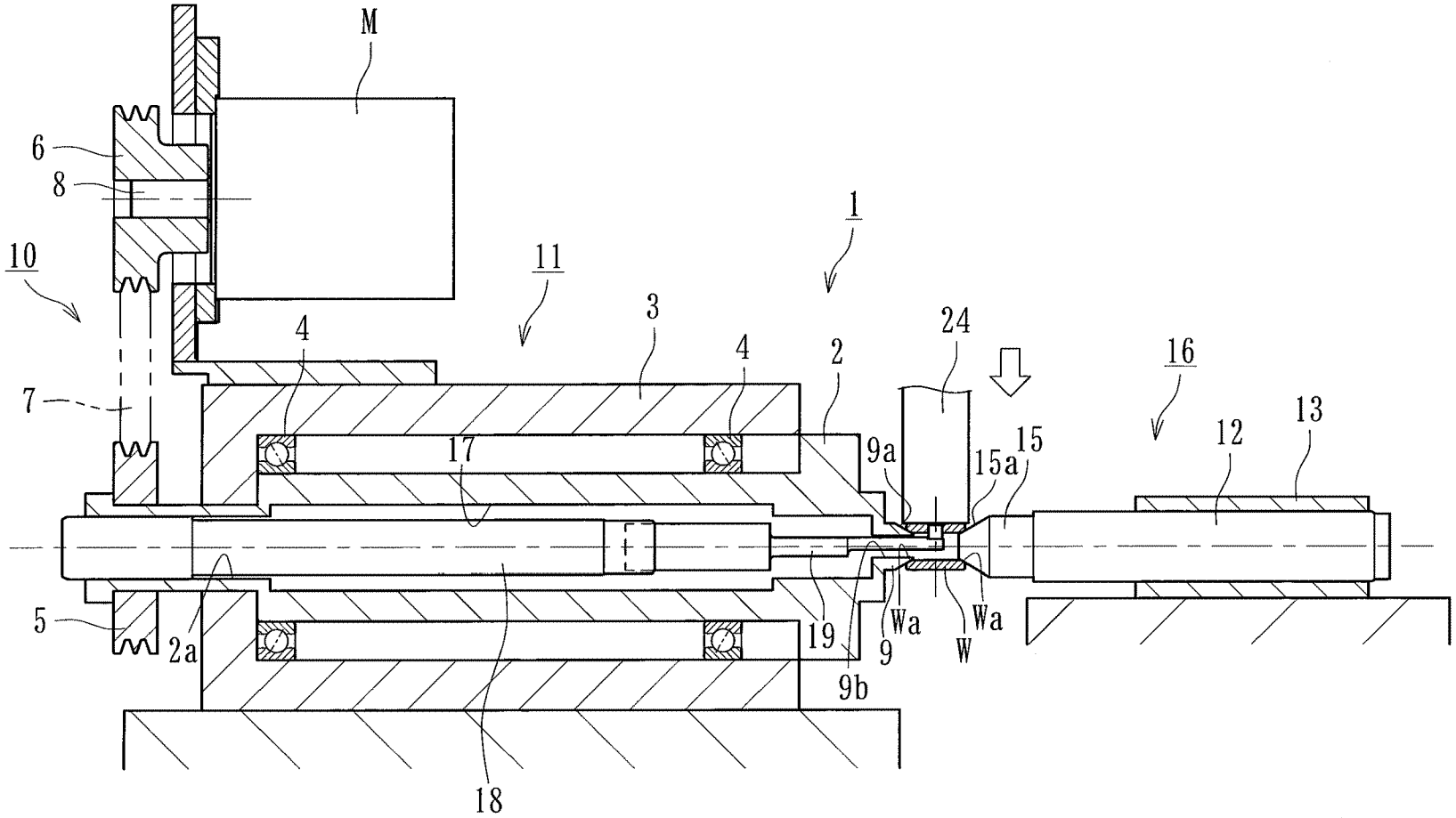
[ Fig 1 ]

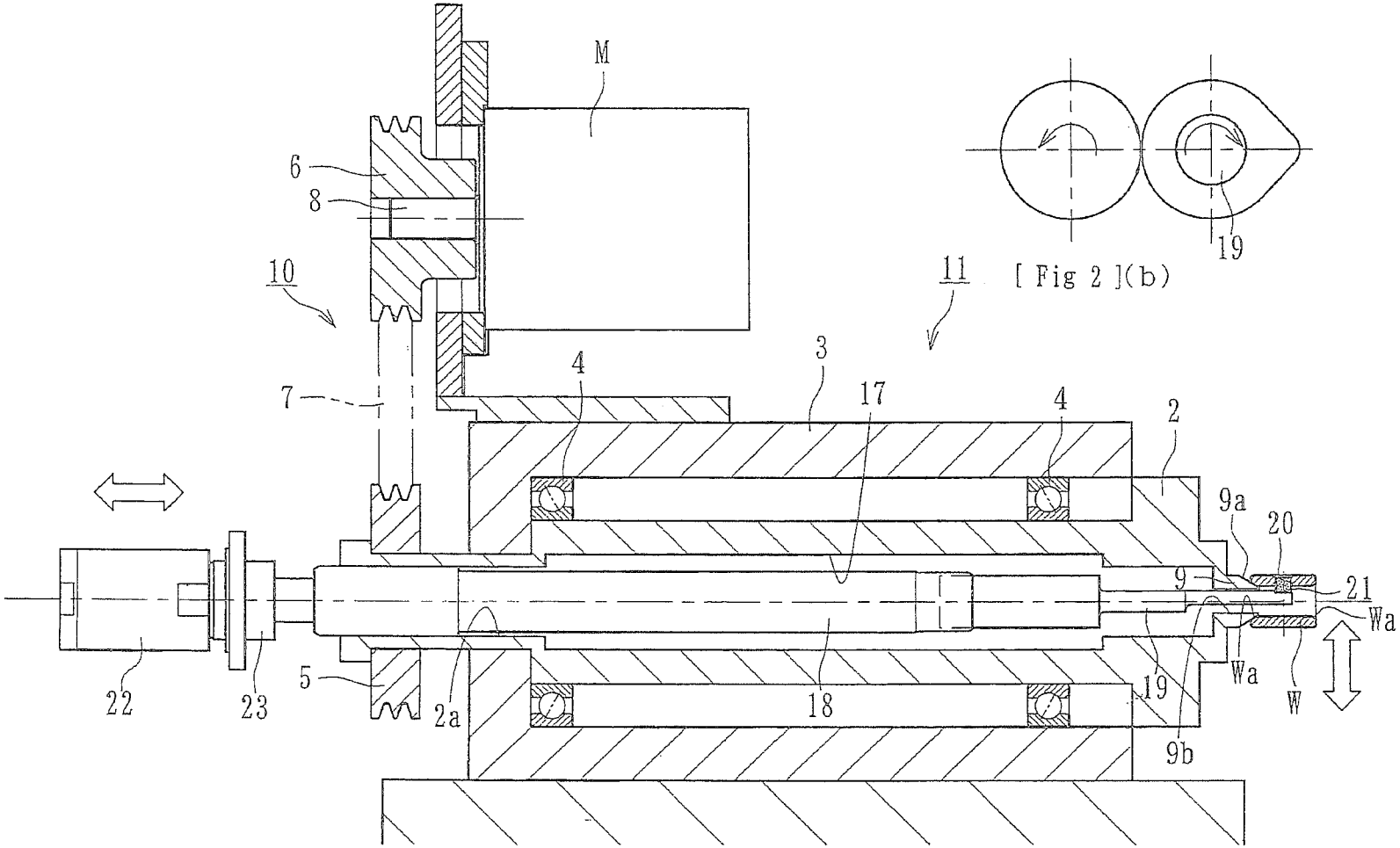
19
[ Fig 2 ](b)
11
M
6
8
10
7
4
4
3
17
2
9a
20
21
Wa
W
Wa
9
9b
19
18
2a
5
23
22
[ Fig 2 ](a)

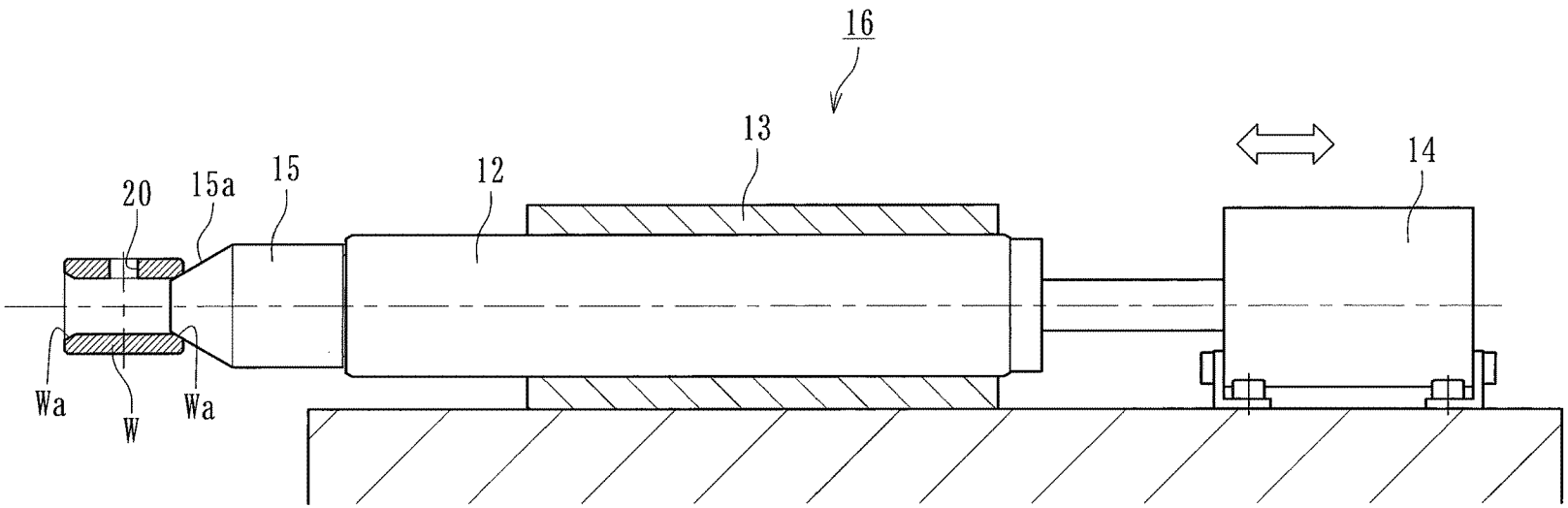
[ Fig 3 ]

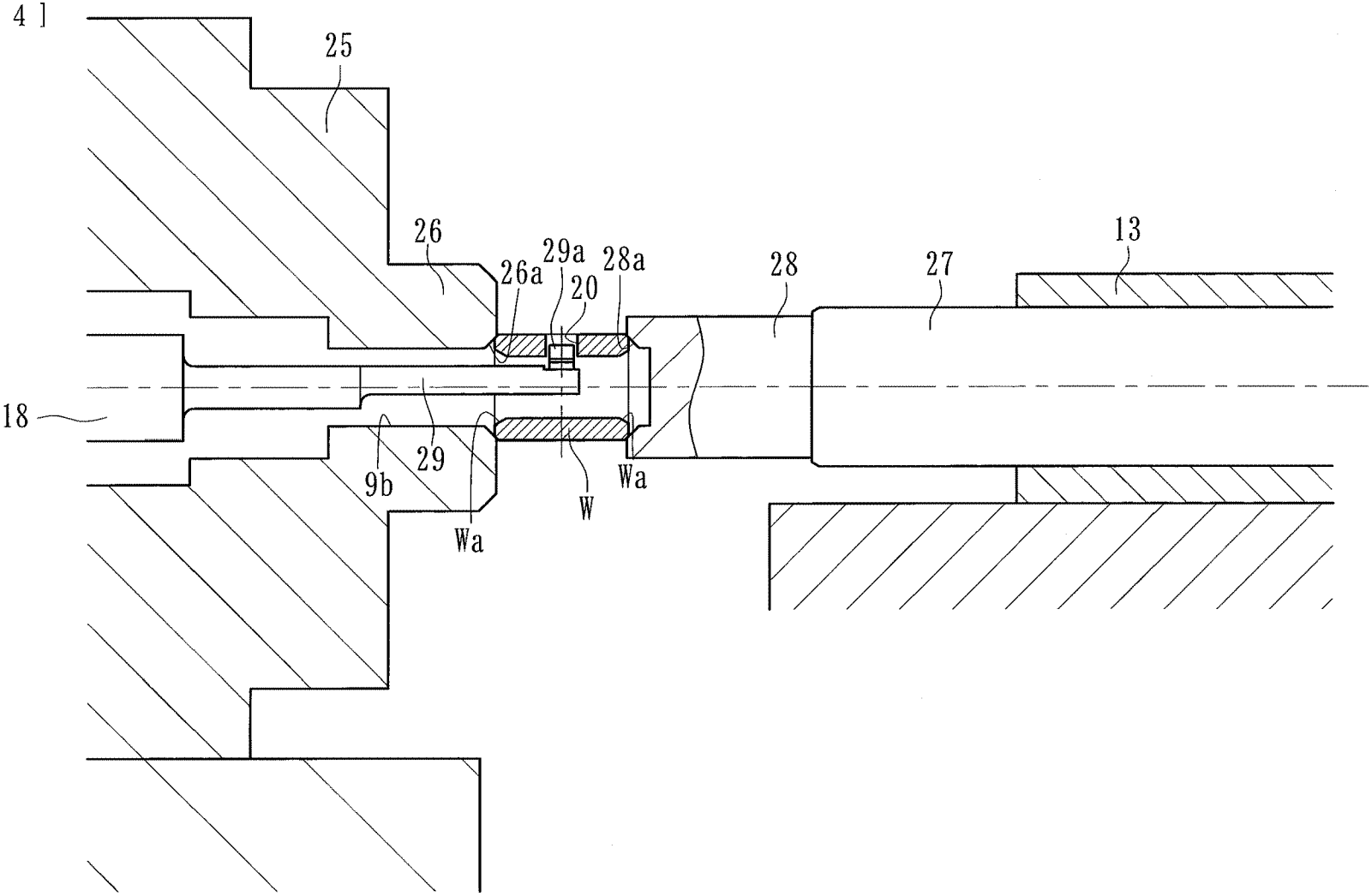
[ Fig 4 ]

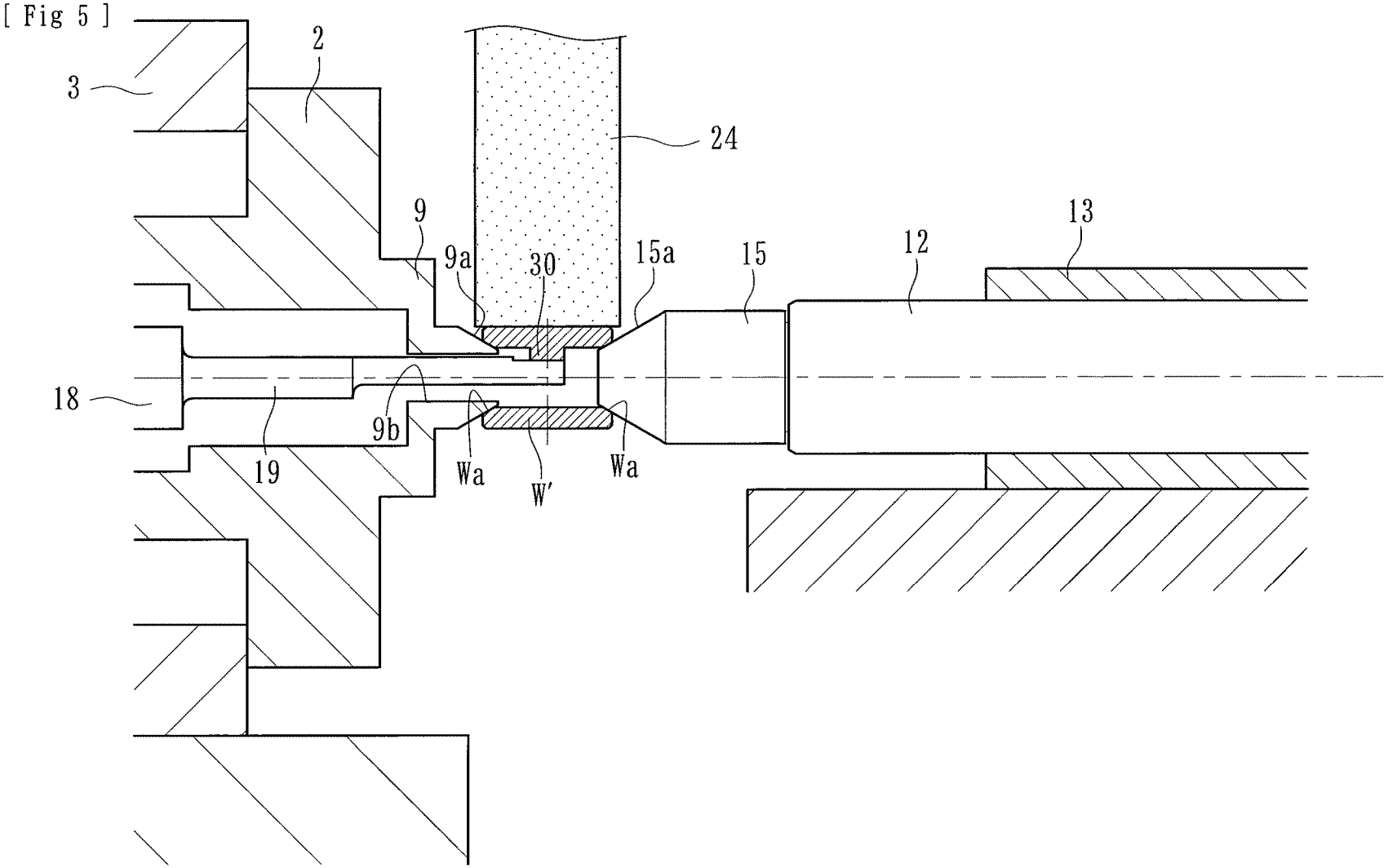
[ Fig 5 ]

PRIOR ART
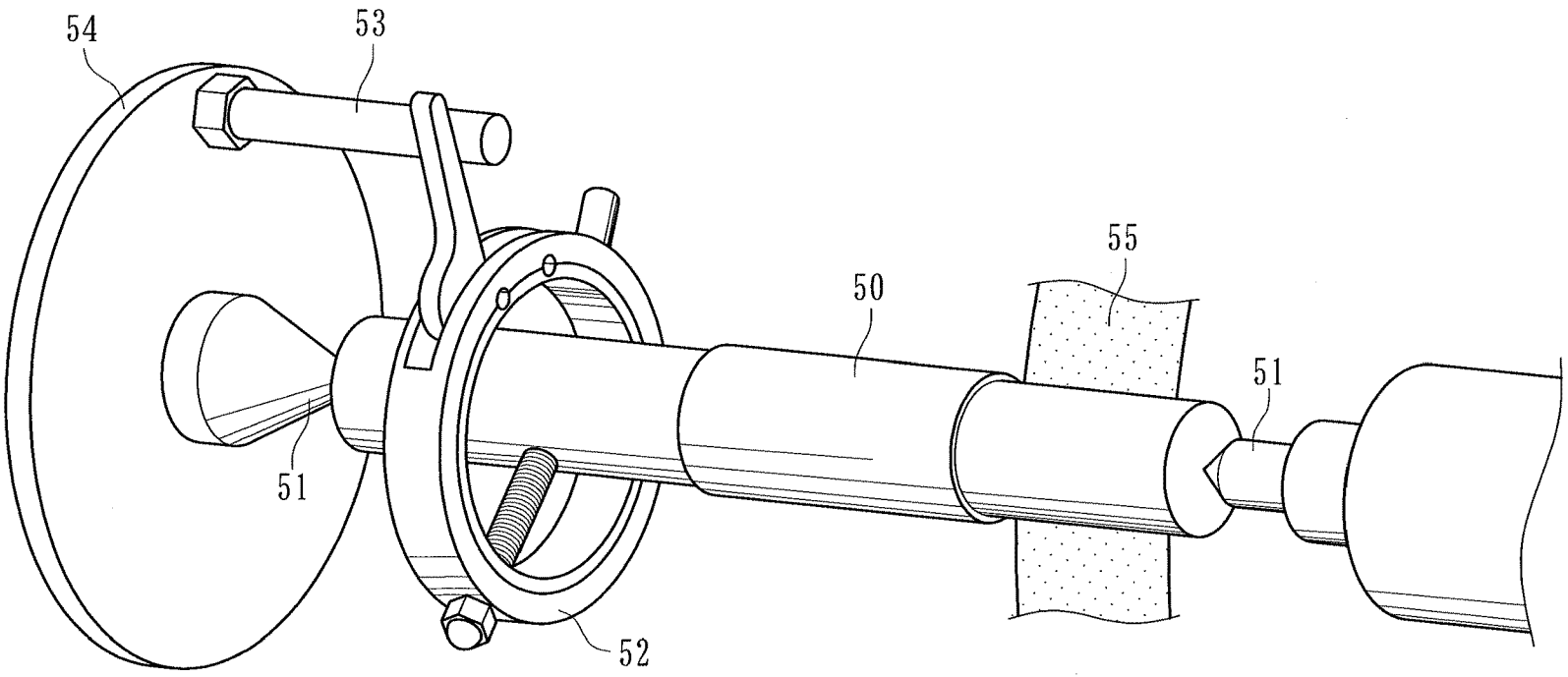
[ Fig 6 ]

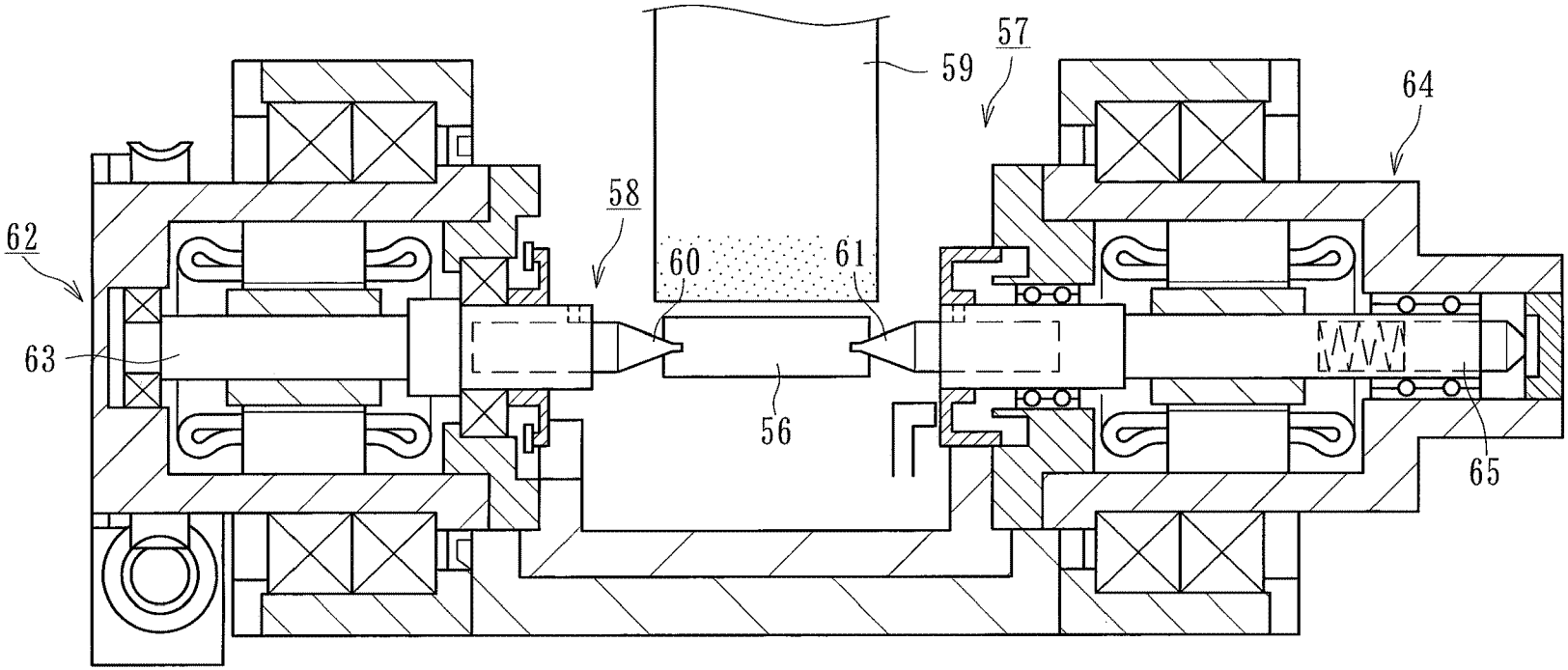
[ Fig 7 ]
PRIOR ART

CYLINDRICAL WORKPIECE AND A METHOD AND AN APPARATUS FOR MACHINING THE CYLINDRICAL WORKPIECE

CROSS-REFERENCE TO RELATED APPLICATIONS

This application is a continuation of International Application No. PCT/JP2015/066095, filed Jun. 3, 2015, which claims priority to Japanese Application No. 2014-116271, filed Jun. 4, 2014. The disclosures of the above applications are incorporating herein by reference.

FIELD

The present disclosure relates to a cylindrical workpiece and a method and an device for machining the cylindrical workpiece. More particularly, the present disclosure relates to a cylindrical workpiece with high concentricity oN an outer circumferential surface relative to an inner circumferential surface. A method and an apparatus for machining the cylindrical workpiece with such a high concentricity is disclosed.

BACKGROUND

In general, centering is usually required for aligning a center of a workpiece 50 and a workpiece rotation axis of a machine tool, as shown in FIG. 6, especially to machine an outer circumferential surface after heat treatment during finish machining by grinding of the cylindrical workpiece or cutting of a hardened steel part. One example of such a machining apparatus of the prior technology is configured to perform grinding on an outer circumferential surface of the workpiece 50 with a grinding wheel 55 under conditions where tapered apertures of both ends of the workpiece 50 are supported by opposite centers 51. An attachment 52 is mounted on part of the outer circumferential surface of the workpiece 50. A kelly (lathe dog) 53 engages the attachment 52. Rotational driving power of a spindle 54 is transmitted to the workpiece 50 to rotate the workpiece 50 integrally with the spindle 54. See, Catalogue published by Kabuto MFG. Co., Ltd. (Page 8, Trade name "Kabuto Clipper").

A machining device 57 is also known for machining a cylindrical workpiece 56 without using the kelly 53, as shown in FIG. 7. This machining device 57 adopts a machining method for grinding the outer circumferential surface of the workpiece 56 using a grinding wheel 59 while supporting the workpiece 56 with a centering apparatus 58. The centering apparatus 58 includes a pair of centers 60 and 61 oppositely arranged toward each other on an axis. One center 60 is detachably mounted on the tip end of a spindle 63 of a spindle unit 62. The other center pin 61 is also detachably mounted on the tip end of a spindle 65 of a tail stock unit 64.

According to this machining apparatus 57, the outer circumferential surface of the workpiece 56 can be ground by contacting the grinding wheel 59 against the outer circumferential surface of the workpiece 56 (see, JP 2003-245855 A).

However, it's problematic that the entire width of the workpiece 50 cannot be ground by one process. This is due to the fact that the kelly 53 prevents the lateral motion of the grinding wheel 55 when trying to grind of the workpiece 50 supported by the kelly 53 in a manner shown in FIG. 6.

On the other hand, when trying to grind the workpiece 56 supported by both the centers 60 and 61 as shown in FIG. 7, since the contact friction force between the centers 60 and 61 and the workpiece 56 is smaller than the machining force and since reduction of the machining speed is required, the machining period of time would be extended. Thus, the manufacturing cost would be increased. In addition, if one is trying to increase the pressing force of the centers 60 and 61 in order to make the contact friction force between the centers 60 and 61 and the workpiece 56 larger than the machining force, the large pressing force will sometimes deform the workpiece 56. This is especially true in thin-walled workpiece. Thus, the roundness of workpiece would be decreased. Accordingly, in order to ensure desired accuracy, it is necessary to perform grinding of the inner circumferential surface of the workpiece again after grinding of the outer circumferential surface. Thus, this increases the machining steps and accordingly the manufacturing cost.

SUMMARY

It is therefore an object of the present disclosure to provide a method and an device for machining a cylindrical workpiece and the cylindrical workpiece machined by the present method and device to have high concentricity on an outer circumferential surface relative to an inner circumferential surface.

To achieve the object, a method for machining a cylindrical workpiece comprises the following steps. The workpiece is supported on a driving center and a centering center. An outer circumferential surface of the workpiece is finish machined by rotating the workpiece under a condition where a kelly, rotated together with the driving center, is engaged with the workpiece within an inner bore of the workpiece.

The workpiece is supported on a driving center and a centering center. An outer circumferential surface of the workpiece is finish machined by rotating the workpiece under a condition where a kelly, rotated together with the driving center, engages the workpiece within an inner bore of the workpiece. Thus, it is possible to machine the entire width of the workpiece during one process. Accordingly, it is possible to improve the concentricity of the outer circumferential surface of the workpiece as well as to reduce the frictional force between both the centers and the workpiece. Thus, this does not only suppress deformation of the workpiece and the generation of damage to the workpiece but also improves the roundness of the workpiece.

An apparatus for machining a cylindrical workpiece comprises a hollow spindle with a driving center on its tip end. The hollow spindle is rotationally journaled within a spindle unit. A tail stock spindle, with a centering center on its tip end, is rotationally supported and axially movable within a centering unit. A shaft-like kelly is non-rotationally supported within an inner bore of the spindle, but is axially movable relative to the spindle. A driving means rotationally drives the spindle. Cylinders axially drive the kelly and the tail stock spindle, respectively. The spindle, the tail stock spindle and the cylinders are arranged on the same axial line. The cylindrical workpiece is supported on the driving center and the centering center in a sandwiched fashion. An outer circumferential surface of the workpiece is finish machined while rotating the workpiece under a condition where the kelly engages the workpiece within an inner bore of the workpiece.

The apparatus for machining a cylindrical workpiece of the present disclosure comprises a hollow spindle with a driving center on its tip end. The hollow spindle is rotationally journaled within a spindle unit. A tail stock spindle, with a centering center on its tip end, is rotationally supported and axially movable within a centering unit. A shaft-like kelly is non-rotationally supported within an inner bore of the spindle. The kelly is axially movable relative to the spindle. A driving means rotationally drive the spindle. Cylinders axially drive the kelly and the tail stock spindle, respectively. The spindle, the tail stock spindle and the cylinders are arranged on the same axial line. The cylindrical workpiece is supported on the driving center and the centering center in a sandwiched fashion. An outer circumferential surface of the workpiece is finish machined while rotating the workpiece under a condition where the kelly engages the workpiece within an inner bore of the workpiece. Thus, it is possible to machine the entire width of the workpiece in one process. Accordingly, it is possible to improve the concentricity of the outer circumferential surface of the workpiece as well as to reduce the frictional force between both centers and the workpiece. Thus, not only does this prevent deformation of the workpiece and the generation of damage on the workpiece but it also improves the roundness of the outer circumferential surface. In addition, since the pressing force of the centers against the workpiece can be reduced, sizes and costs of auxiliary equipment, such as hydraulic devices, and thus the machining apparatus itself can also be reduced. Furthermore, it is possible to increase the machining speed since a large driving force can be obtained on the workpiece as compared with the driving force obtained by only the frictional force of the centers. Thus, this reduces the machining time and the manufacturing cost.

A tip end of each the driving center and the centering center is formed with a tapered outer surface, respectively. Tapered chamfer surfaces are formed on both inner end surfaces of the workpiece. The workpiece is supported at its inner end surfaces with the tapered chamfer surfaces engaging the tapered surfaces of the driving center and the centering center.

A tip end of each of the driving center and the centering center is formed with a tapered inner surface, respectively. The workpiece is supported at its outer end surfaces with the outer end surfaces of the workpiece engaging the tapered inner surfaces of the driving center and the centering center. This makes it possible to further improve the roundness of the outer circumferential surface of the workpiece while suppressing the deformation of the workpiece during machining.

The workpiece is formed with the kelly engaging a through aperture or a radially inward projection. Thus, this makes it possible to easily engage the kelly with the workpiece.

The apparatus for machining a cylindrical workpiece further comprises an index mechanism to index the position of the kelly. This makes it possible to advance the kelly to a predetermined position within the inner bore of the workpiece.

A cylindrical workpiece comprises tapered chamfer surfaces formed on both inner end surfaces of the workpiece. A finish machined inner circumferential surface, the inner circumferential surface and the tapered chamfer surfaces are formed by simultaneous cutting. An outer circumferential surface is finish machined after heat treatment utilizing the tapered chamfer surface support. It is possible to eliminate the grinding process on the inner circumferential surface of the cylindrical workpiece of the present disclosure after grinding of the outer circumferential surface. This improves the concentricity of the inner and outer circumferential surfaces while increasing the supporting accuracy of the cylindrical workpiece.

The method for machining a cylindrical workpiece of the present disclosure comprises the following steps. The workpiece is supported on a driving center and a centering center. An outer circumferential surface of the workpiece is finished machined by rotating the workpiece under a condition where a kelly, rotated together with the driving center, engages the workpiece within an inner bore of the workpiece. Thus, it is possible to machine the entire width of the workpiece in one process. Accordingly, it is possible to improve the concentricity of the outer circumferential surface of the workpiece as well as to reduce the frictional force between both the centers and the workpiece. Thus, not only does this prevent deformation of the workpiece and the generation of damage on the workpiece but it also improves the roundness of the outer circumferential surface of the workpiece.

The device for machining a cylindrical workpiece of the present disclosure comprises a hollow spindle with a drive center on its tip end. The hollow spindle is rotationally journaled within a spindle unit. A tail stock spindle, with a centering center on its tip end, is rotationally supported and axially movable within a centering unit. A shaft-like kelly is non-rotationally supported within an inner bore of the spindle. The kelly is axially movable relative to the spindle. A driving means rotationally drives the spindle. Cylinders axially drive the kelly and the tail stock spindle, respectively. The spindle, the tail stock spindle and the cylinders are arranged on the same axial line. The cylindrical workpiece is supported on the driving center and the centering center in a sandwiched fashion. An outer circumferential surface of the workpiece is finish machined by rotating the workpiece under a condition where the kelly engages the workpiece within an inner bore of the workpiece. Thus, it is possible to machine the entire width of the workpiece by one process. Accordingly, it is possible to improve the concentricity of the outer circumferential surface of the workpiece as well as to reduce the frictional force between both the centers and the workpiece. Thus, not only does this prevent deformation of the workpiece and the generation of damage on the workpiece but it also improves the roundness of the outer circumferential surface. In addition, the pressing force of the centers against the workpiece can be reduced. Sizes and costs of auxiliary equipment, such as hydraulic devices, and thus the machining apparatus itself can be also reduced. Furthermore, a large driving force on the workpiece can be obtained compared with the driving force obtained by only the frictional force of the centers. Thus, it is possible to increase the machining speed and reduce the machining time and the manufacturing cost.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a longitudinal cross-section view of a first embodiment of a machining device of a cylindrical workpiece of the present disclosure.

FIG. 2(*a*) is a longitudinal cross-section view of a spindle unit of the machining device of FIG. 1.

FIG. 2(*b*) is a schematic view of an index mechanism of the machining device of FIG. 1.

FIG. 3 is a longitudinal cross-section view of a centering unit of the machining device of FIG. 1.

FIG. 4 is a partially enlarged cross-section view of a second embodiment of a machining device of a cylindrical workpiece of the present disclosure.

FIG. 5 is a partially enlarged cross-section view of a third embodiment of a machining device of a cylindrical workpiece of the present disclosure.

FIG. 6 is a perspective view of a prior art machining device of a cylindrical workpiece.

FIG. 7 is a longitudinal cross-section view of another prior technology machining device of a cylindrical workpiece.

DETAILED DESCRIPTION

Hereafter, embodiments of the present disclosure will be specifically described with reference to the attached drawings.

An apparatus for machining a cylindrical workpiece comprises a hollow spindle with a driving center on its tip end. The hollow spindle is rotationally journaled within a spindle unit. A tail stock spindle, with a centering center on its tip end, is rotationally supported and axially movable within a centering unit. A shaft-like kelly is non-rotationally supported within an inner bore of the spindle. The kelly is axially movable relative to the spindle. A driving means rotationally drives the spindle. Cylinders axially drive the kelly and the tail stock spindle, respectively. The spindle, the tail stock spindle and the cylinders are arranged on the same axial line. The cylindrical workpiece is supported on the driving center and the centering center in a sandwiched fashion. An outer circumferential surface of the workpiece is finish machined while rotating the workpiece under a condition where the kelly engages an inner bore of the workpiece.

Preferable embodiments of the present disclosure will be described more in detail with reference to accompanied drawings.

FIG. 1 is a longitudinal cross-section view of a first embodiment of a machining device of a cylindrical workpiece of the present disclosure. FIG. 2(*a*) is a longitudinal cross-section view of a spindle unit of the machining device of FIG. 1. FIG. 2(*b*) is a schematic view of an index mechanism of the machining device of FIG. 1. FIG. 3 is a longitudinal cross-section view showing a centering unit of the machining device of FIG. 1.

As shown in FIG. 1, a machining apparatus 1 is applied to perform finish machining (grinding or cutting of hardened steel) of an outer circumferential surface after heat treatment. Chamfered surfaces Wa are formed on both ends of a thin-walled cylindrical workpiece W. The chamfered surfaces improve the support accuracy of the workpiece W. The concentricity between the inner and outer circumferential surfaces is improved. The chamfered surfaces Wa and the inner circumferential surface are usually simultaneously ground.

A spindle 2, formed with a hollow shaft, is rotationally supported on a spindle frame 3 by a pair of rolling bearings (herein angular contact ball bearings) 4 and 4. A pulley 5 is secured on the rear end of the spindle 2. The pulley 5 is connected to a driving pulley 6 via a belt 7. The spindle 2 can be rotationally driven by a driving motor M, via the driving pulley 6 secured on a motor shaft 8, the belt 7 and the pulley 5. A tip end of the spindle 2 has a driving center 9 formed with a tapered surface 9*a*. The tapered surface 9*a* is adapted to engage (contact) the chamfered surface Wa of the workpiece W. The spindle frame 3 and a rotationally driving means 10, comprising the spindle 2, drive motor M, pulleys 5 and 6 and belt 7, constitute a spindle unit 11.

A tail stock spindle 12 is axially slidably mounted within a centering frame 13. The tail stock spindle 12 is driven by a cylinder 14 (FIG. 3). A tip end of the tail stock spindle 12 has a centering center 15. The centering center 15 is formed with a tapered surface 15*a* adapted to engage the chamfered surface Wa of the workpiece W. The centering frame 13, tail stock spindle 12 and the cylinder 14 constitute a centering unit 16. The spindle 2, driving center 9, cylinder 14, tail stock spindle 12 and centering center 15 are arranged on a same axis.

As shown in FIG. 2(*a*), a kelly drive shaft 18 is arranged within an inner bore 17 of the hollow spindle 2. A shaft-shaped kelly 19 is detachably fit in the tip end of the kelly driving shaft 18. The kelly drive shaft 18 and the kelly 19 are axially slidably guided by a guide bore 2*a*. The guide bore 2*a* is formed in the rear end of the spindle 2. Serrations or splines (not shown) are formed on the guide bore 2*a* of the spindle 2. The serrations non-rotationally support the kelly drive shaft 18, along with the inner bore of the drive center, relative to the spindle 2. A through aperture 20 is formed in the workpiece W. An engagement member 21, engaging with the kelly 19, can be fit in the through aperture 20. The through aperture 20 may use a through aperture where a bridge member or a return tube of a ball circulating member is fit when the workpiece W is a nut member of a ball screw. The kelly driving shaft 18 can be moved forward and backward by the cylinder 22. The workpiece W can be rotationally driven by the kelly 19. The kelly 19 engages the engagement member 21 fit in the through aperture 20 of the workpiece W.

Although it is described that the kelly 19 engages with the engagement member 21 fit in the through aperture 20 of the workpiece W and projects therefrom into the inner bore of the workpiece W, it may be possible to integrally form an engagement piece on the tip of the kelly 19. Thus, the engagement piece can be engaged with the through aperture 20 to rotationally drive the workpiece W. In this case, an index mechanism, as shown in FIG. 2(*b*), is provided. The index mechanism automatically indexes the position of the kelly 19 and drives the kelly 19 to a predetermined position (shown by arrows in FIG. 2(*b*)).

A numeral 23 denotes a coupling arranged between the cylinder 22 and the kelly drive shaft 18. The coupling 23 is formed from an elastic member such as rubber. The coupling 23 enables transmission of the pressing force to enable axis misalignment between the cylinder 22 and the kelly driving shaft 18. Also, the coupling absorbs shock when the kelly 19 abuts against the engagement member 21.

According to this embodiment, axes of the kelly 19 and the kelly drive shaft 18 are eccentrically arranged with respect to each other by a predetermined amount. This prevents the kelly 19 and the engagement member 21 from interfering with each other when the kelly 19 advances within the workpiece W. This achieves easy engagement of the kelly 19, with the engagement member 21, via rotation, without largely projecting the engagement member 21 from the through aperture 20 of the workpiece W.

As shown in FIG. 3, the tail stock spindle 12 of the centering unit 16 is moved axially forward and backward by the cylinder 14, as shown by a double arrow. Similar to the cylinder 22 described above, the cylinder 14 is also driven by pneumatic or hydraulic power.

Grinding operation of the machining apparatus for the cylindrical workpiece of the present disclosure will be described in more detail with reference to FIGS. 1 to 3.

When the tail stock spindle 12 is moved backward by the cylinder 14 of the centering unit 16 and the cylindrical workpiece W is fed between the driving center 9 and the centering center 15, the tail stock spindle 12 is moved forward. The workpiece W is supported on both centers 9 and 15 in a sandwiched fashion. The kelly drive shaft 18 is moved forward by the cylinder 22 of the spindle unit 11. The kelly 19, fit in the tip end of the kelly driving shaft 18, is advanced into the inner bore of the workpiece W.

The spindle 2 is rotated via the rotationally driving means 10 by actuating the electric motor M. In accordance with the rotation of the spindle 2, the workpiece W is rotated together with the centering center 15, via frictional force between the workpiece W and both centers 9 and 15.

The grinding wheel 24 is advanced toward the workpiece W and contacts it. The outer circumferential grinding (so-called plunge grinding) of the workpiece W is performed. As can be seen from the description above, the kelly drive shaft 18, fit in the inner bore 17 of the spindle 2, is rotated together with the spindle 2. The kelly 19, fit in the tip end of the kelly drive shaft 18, is also rotated. The kelly 19 engages the engagement member 21 fit in the through aperture 20 of the workpiece W. This drives the workpiece W from the inner bore of the workpiece W. Thus, it is possible to machine the entire width of the workpiece W by one process. Accordingly, it is possible to improve the concentricity of the outer circumferential surface of the workpiece W as well as to reduce the frictional force between both the centers 9 and 15 and the workpiece W. Thus, this prevents deformation of the workpiece W and the generation of damage on the workpiece W.

In addition, a large driving force on the workpiece W can be obtained compared with the driving force obtained by only the frictional force of the centers 9 and 15. Thus, the driving force of the workpiece W can bear against a large machining resistance. Accordingly, it is possible to increase the machining speed and thus reduce the machining time and the manufacturing cost. Furthermore, the pressing force of the centers 9 and 15 against the workpiece W can be reduced. Sizes and costs of auxiliary equipment, such as hydraulic devices, and thus the machining apparatus itself can also be reduced. When a cylindrical workpiece is required to have a high accuracy of concentricity as that described above, it is possible to obtain a high concentricity between inner and outer circumferential surfaces even if the grinding step of the inner circumferential surface after grinding of the outer circumferential surface is eliminated.

FIG. 4 is a partially cross-section enlarged view of a second embodiment of the machining apparatus of a cylindrical workpiece of the present disclosure. This embodiment is different from the first embodiment only in the supporting fashion of the workpiece W. Thus, the same reference numerals are used to identify parts or elements having the same functions as those used in the first embodiment and the detailed description of them will be omitted.

A spindle 25 is formed with a driving center 26 at the tip end of the spindle 25. The driving center 26 is formed with a tapered chamfer surface 26*a* on the inner circumferential surface of the tip end of the driving center 26. The tapered chamfer surface 26*a* is adapted to engage (contact) the outer tapered chamfer surface of the workpiece W. A tail stock spindle 27 is formed with a centering center 28 at the tip end of the tail stock spindle 27. The centering center 28 is formed with a tapered chamfer surface 28*a* on the inner circumferential surface of the tip end of the centering center 28. The tapered chamfer surface 28*a* is adapted to engage the outer tapered chamfer surface of the workpiece W. The spindle 25, driving center 26, tail stock spindle 27 and centering center 28 are arranged on a same axis.

In this embodiment, a kelly 29, secured on the kelly drive shaft 18, can be moved forward and backward by a cylinder (not shown). The kelly 29 is integrally formed with an engagement piece 29*a*. The engagement piece 29*a* engages the through aperture 20 formed on the workpiece W to rotate the workpiece W. Similarly to the first embodiment, an axis of the kelly 29 is eccentrically formed relative to an axis of the kelly drive shaft 18, by a predetermined amount. It is preferable to provide an elastic member, such as rubber, on the tip end of the engagement piece 29*a* of the kelly 29 to prevent the workpiece W from being damaged when the engagement piece 29*a* engages the through aperture 20.

When the tail stock spindle 27 is moved backward and the cylindrical workpiece W is fed between the driving center 26 and the centering center 28, the tail stock spindle 27 is moved forward. The workpiece W is supported on both centers 26 and 28 in a sandwiched fashion. The kelly drive shaft 18 is moved forward and the kelly 29, fit in the tip end of the kelly drive shaft 18, is advanced into the inner bore of the workpiece W. The spindle 25 is rotated by actuating the electric motor M (not shown). In accordance with the rotation of the spindle 25, the workpiece W is rotated, via frictional force, between the workpiece W and both centers 26 and 28.

As described above, the kelly drive shaft 18, fit in the spindle 25, is rotated together with the spindle 25. Similarly to the first embodiment, the engagement piece 29*a* of the kelly 29 engages the through aperture 20 of the workpiece W. This drives the workpiece W from the inner bore of the workpiece W. Thus, it is possible to machine the entire width of the workpiece W by one process. Accordingly, it is possible to improve the concentricity of the outer circumferential surface of the workpiece W as well as to reduce the frictional force between both the centers 26 and 28 and the workpiece W. Thus, this prevents deformation of the workpiece W and further improves the roundness of the outer circumferential surface of the workpiece W.

In addition, a large driving force of the workpiece W can be obtained. Thus, the driving force of the workpiece W can bear against a large machining resistance. Thus, it is possible to increase the machining speed and reduce the machining time and the manufacturing cost. Furthermore, the pressing force of the centers 26 and 28 against the workpiece W can be reduced. Sizes and costs of auxiliary equipment, such as hydraulic devices, and thus the machining apparatus itself can be also reduced.

FIG. 5 is a partially enlarged cross-section view of a third embodiment of the machining apparatus of a cylindrical workpiece of the present disclosure. This embodiment is different from the first embodiment only in the structure of the workpiece. The same reference numerals are used to identify parts or elements having the same functions as those used in the first embodiments and the detailed description of them will be omitted.

The spindle 2 is integrally formed with the driving center 9 at its tip end. The tapered surface 9*a* engages with the chamfered surface Wa of a workpiece W'. The tail stock spindle 12 is formed with the centering center 15 at its tip end. The tapered surface 15*a* of the centering center 15 engages the chamfered surface Wa of the workpiece W'.

According to this embodiment, the workpiece W' is formed with a projection 30 on its inner circumferential surface. The kelly 19 secured on the kelly drive shaft 18 can be moved forward and backward by a cylinder (not shown). The kelly 19 engages the projection 30 formed on the inner circumferential surface of the workpiece W' to rotate the workpiece W'. Similarly to the previous embodiments, the axis of the kelly 19 is eccentrically formed relative to the axis of the kelly drive shaft 18 by a predetermined amount.

When the tail stock spindle 12 is moved backward and the cylindrical workpiece W' is fed between the driving center 9 and the centering center 15, the tail stock spindle 12 is moved forward. The workpiece W' is supported on both centers 9 and 15 in a sandwiched fashion. The kelly drive shaft 18 is moved forward. The kelly 19, secured on the tip end of the kelly drive shaft 18, is advanced into the inner bore of the workpiece W'. The spindle 2 is rotated by actuating the electric motor M. The workpiece W' is rotated by frictional force between the workpiece W' and both centers 9 and 15.

As described above, the kelly drive shaft 18, fit in the spindle 2, is rotated together with the spindle 2. The kelly 19 engages the projection 30 of the workpiece W' to drive the workpiece W' from the inner bore of the workpiece W'. Thus, it is possible to machine the entire width of the workpiece W' by one process. Accordingly, it is possible to improve the concentricity of the outer circumferential surface of the workpiece W' as well as to reduce the frictional force between both the centers 9 and 15 and the workpiece W'. Thus, this improves the roundness of the outer circumferential surface of the workpiece W' while preventing deformation of the workpiece W' during machining.

According to this embodiment of the present disclosure, the workpiece W' can be supported by the centers under the condition of inner bore support via the chamfered surface Wa, even if the workpiece W' has been deformed due to heat treatment. Accordingly, it is possible to have machining with high accuracy of the workpiece W' with the roundness within 10 μm of the outer circumferential surface and the concentricity within 50 μm of the outer circumferential surface on the basis of the chamfered surface Wa as datum.

In addition, a large driving force of the workpiece W' can be obtained. Thus, the driving force of the workpiece W' can bear against a large machining resistance. Thus, it is possible to increase the machining speed and thus reduce the machining time and the manufacturing cost. Furthermore, the pressing force for supporting the workpiece W' can be reduced. Sizes and costs of auxiliary equipment, such as hydraulic devices, and thus the machining apparatus itself can be also reduced.

The apparatus for machining a cylindrical workpiece of the present disclosure can be applied to a machining apparatus for performing finish machining, such as grinding, of an outer circumferential surface of a cylindrical workpiece on the basis of an inner circumferential surface after heat treatment of the workpiece.

The present disclosure has been described with reference to the preferred embodiments. Obviously, modifications and alternations will occur to those of ordinary skill in the art upon reading and understanding the preceding detailed description. It is intended that the present disclosure be construed to include all such alternations and modifications insofar as they come within the scope of the appended claims or their equivalents.

What is claimed is:

1. A method for machining a cylindrical workpiece comprising steps of:

supporting the workpiece on a driving center and a centering center, the workpiece formed with a through aperture or a radially inward projection; and finish machining an outer circumferential surface of the workpiece by rotating the workpiece under a condition where a kelly, embedded into a hollow spindle, has an engagement piece integrally a tip end of a kelly driving shaft, the kelly is arranged on a same axial line with a driving cylinder and the kelly, detachably fitted in the tip end of the kelly driving shaft, is axially driven by the driving cylinder, and rotated together with the driving center by the spindle, the kelly is moved in a radial direction and the engagement piece is engaged with the through aperture or a radially inward projection of the workpiece within an inner bore of the through aperture or a radially inward projection of the workpiece.

2. The apparatus for machining a cylindrical workpiece comprising:

a hollow spindle with a driving center on its tip end, the hollow spindle rotationally journaled within a spindle unit;

a tail stock spindle with a centering center, the tail stock spindle rotationally supported and axially movably within a centering unit;

a shaft-like kelly non-rotationally supported within an inner bore of the hollow spindle, the shaft-like kelly is rotational with the hollow spindle and is axially movably relative to the hollow spindle and the kelly has an engagement piece integrally formed on the tip;

a driving means for rotationally driving the hollow spindle;

cylinders axially driving the kelly and the tail stock spindle, respectively; and the spindle, the tail stock spindle and the cylinders are arranged on a same axial line, the cylindrical workpiece, formed with a through aperture or a radially inward projection, is supported on the driving center and the centering center in a sandwiched fashion, and an outer circumferential surface of the workpiece is finish machined while rotating the workpiece under a condition where the kelly is moved in the radial direction and engages with the through aperture or a radially inward projection of the workpiece within an inner bore of the through aperture or radially inward projection of the workpiece.

3. The apparatus for machining a cylindrical workpiece of claim 2, wherein a tip end of each the driving center and the centering center is formed with a tapered outer surface, respectively, wherein tapered chamfer surfaces are formed on both inner end surfaces of the workpiece, and the workpiece is supported at its inner end surfaces with the tapered chamfer surfaces engaging the tapered surfaces of the driving center and the centering center.

4. The apparatus for machining a cylindrical workpiece of claim 2, wherein a tip end of each the driving center and the centering center is formed with a tapered inner surface, respectively, and the workpiece is supported at its outer end surfaces with the outer end surfaces of the workpiece engaging the tapered inner surfaces of the driving center and the centering center.

5. The apparatus for machining a cylindrical workpiece of claim 2, wherein the workpiece is formed with a through aperture or a radially inward projection for engaging the kelly.

6. The apparatus for machining a cylindrical workpiece of claim 2, further comprising an index mechanism for indexing the position of the kelly.

* * * * *